US006935426B1

(12) United States Patent
Rainbolt et al.

(10) Patent No.: US 6,935,426 B1
(45) Date of Patent: Aug. 30, 2005

(54) SYSTEM AND METHOD FOR POLYMER FILTER CAKE REMOVAL

(75) Inventors: Michael F. Rainbolt, Plano, TX (US); Andrew W. Tullis, Cedar Hill, TX (US)

(73) Assignee: Encana Oil & Gas (USA) Inc., Dallas, TX (US)

( * ) Notice: Subject to any disclaimer, the term of this patent is extended or adjusted under 35 U.S.C. 154(b) by 186 days.

(21) Appl. No.: 10/357,943

(22) Filed: Feb. 4, 2003

(51) Int. Cl.[7] ..... E21B 43/27

(52) U.S. Cl. ..... 166/279; 166/300; 166/307; 166/308.2

(58) Field of Search ..... 166/279, 300, 166/304, 305.1, 307, 308.2, 310–312, 400–403

(56) References Cited

U.S. PATENT DOCUMENTS

| | | | |
|---|---|---|---|
| 5,165,477 | A | 11/1992 | Shell et al. |
| 5,238,065 | A | 8/1993 | Mondshine et al. |
| 5,247,995 | A | 9/1993 | Tjon-Joe-Pin et al. |
| 5,251,697 | A | 10/1993 | Shuler |
| 5,325,921 | A | 7/1994 | Johnson et al. |
| 5,458,197 | A | 10/1995 | Chan |
| 5,501,276 | A | 3/1996 | Weaver et al. |
| 5,607,905 | A | 3/1997 | Dobson, Jr. et al. |
| 5,783,527 | A | 7/1998 | Dobson, Jr. et al. |
| 5,888,944 | A | 3/1999 | Patel |
| 5,909,774 | A | 6/1999 | Griffith et al. |
| 6,138,760 | A | 10/2000 | Lopez et al. |
| 6,422,314 | B1 | 7/2002 | Todd et al. |
| 2004/0040706 | A1 * | 3/2004 | Hossaini et al. ..... 166/278 |

OTHER PUBLICATIONS

Shuchart, Chris E. et al. "Novel Oxidizing Breaker for High-Temperature Fracturing", Society of Petroleum Engineers (1997) pp. 1-9.

* cited by examiner

*Primary Examiner*—Zakiya Walker
(74) *Attorney, Agent, or Firm*—Fulbright & Jaworski LLP

(57) ABSTRACT

Embodiments provide systems and methods in which a non-viscous fluid, having a heavy concentration of an appropriate breaker, is pumped into a well in front of viscosified fluid, such as a cross-linked polymeric fracturing fluid, to saturate permeable media with a breaker agent. When a polymer filter cake is subsequently formed on the surfaces of the media the breaker is provided good communication with the polymer filter cake for its breakdown and removal. Communication between the breaker and the polymer filter cake is substantially controlled by an operator in that the breaker remains saturated in the permeable media until such time as the operator decreases hydraulic pressure within the well to a point at which the hydraulic pressure of the media forces the breaker back into the well.

43 Claims, 3 Drawing Sheets

520
520
520
511
501
501
521
501
510
501
520
520
520
100

SYSTEM AND METHOD FOR POLYMER FILTER CAKE REMOVAL

TECHNICAL FIELD

The present invention relates generally to oil and gas well completion operations and, more particularly, to providing efficient removal of polymer or filter cake formed with respect to such completion operations.

BACKGROUND OF THE INVENTION

In preparing a well, such as those bored to produce hydrocarbons, for increased production a process of hydraulic fracturing is often used. For example, hydraulic fracturing may be used to extend the effective radius of a wellbore and, thereby, provide increased surface areas, such as to expose more surface area of a hydrocarbon bearing formation and facilitate an increase in the flow of hydrocarbons from the well.

Hydraulic fracturing involves pumping fluids into a well with enough injection rate and pressure to create a fracture in subterranean formations. For example, a casing disposed in a wellbore may be perforated at a depth or depths corresponding to hydrocarbon producing formations. Thereafter, fracturing fluids, such as viscous and/or non-viscous fluids with or without proppants suspended therein, may be injected down the wellbore casing at sufficient volume and pressure to interface with the hydrocarbon producing formations, via the aforementioned perforations, and cause stress fracturing thereof. The aforementioned proppants may be relied upon to remain within the resulting fractures to prevent their closing upon removal of pressure and the fracturing fluid.

Viscosifiers are often used in hydraulic fracturing in order to keep proppants suspended in the fluid for better and more uniform delivery of the proppants into fractures. Such viscosifiers may comprise polymers, such as guar, hydroxypropylguar (HPG), carboxymethylhydroxypropylguar (CMHPG), hydroxyethylcellulose (HEC), carboxymethylhydroxyethylcellulose (CMHEC), carboxymethylcellulose (CMC), and the like, to produce a linear gel. Such linear gels may be produced having such concentrations as 20 to 60 pounds of polymer per 1000 gallons of base fluid, e.g., water.

Although providing increased viscosity as compared to non-viscosified base fluids, in many cases linear gels have insufficient viscosity to adequately transport proppants. Such linear gels may require addition of a significant amount of such polymers to appreciably increase the resulting viscosity. Accordingly, cross-linking is often used to increase viscosity. Cross-linked gelled fluids may be produced by adding cross-linking agents, such as compounds of borate, titanium, zirconium, antimony, aluminum, and the like. Such cross-linked fluids achieve high viscosity at relatively low polymer loadings.

As previously mentioned, viscosifiers are utilized in order to transport proppants, such as sand, resin-coated sand, and ceramics, into a fracture created by the hydraulic pressure. For example, a viscous hydraulic fracturing fluid is utilized not only to carry the proppants to the fracture, but distribute the proppant material throughout the fracture from the casing perforations to the end of the fracture. In the process of fracturing a subterranean formation the proppant laden fluids are passed over porous, permeable media, e.g., the hydrocarbon bearing sands or hydrocarbon bearing carbonates. As the proppant laden fluid flows over this media, the base fluid, e.g., water, is filtered out leaving the dehydrated viscosifier to plate out on the fracture faces, e.g., on the surface of the hydrocarbon bearing sands, resulting in a polymer filter cake.

The aforementioned polymer filter cake is generally very tough and often is substantially impermeable to fluids. The formation of polymer filter cake is a serious problem in the production of hydrocarbons from a well suffering from such damage as the gel residue plugs up porous hydrocarbon producing media reducing or preventing the flow of the desired hydrocarbons.

Polymer filter cake results from the use of both liner gels as well as cross-linked gels. However, although providing improved viscosity, and therefore often providing better distribution of proppants, polymer filter cake residue resulting from cross-linked gels is often less fluid permeable and typically more difficult to remove.

Agents, called breakers (polymer-degrading agents), have been developed to degrade the viscosified fluids to permit them to flow out of the well after the hydraulic fracture treatment is pumped. However, it is very difficult to break or degrade the polymer filter cake because it is difficult to get breakers to the polymer filter cake material in sufficient quantities to cause the polymer filter cake to be degraded or removed. For example, it is very difficult to get good communication between breaker pumped into the well during the fracturing process and the polymer filter cake as the breaker spends itself on the fracturing fluid gel, leaving very little breaker to react with the polymer filter cake.

It would seem that a solution would be to add more breaker. However, the amount of breaker that may be utilized is limited because if too much breaker is added to the fracturing fluids a premature degradation of viscosity will occur and the treatment will be damaged. Although total breaker loading may be increased via use of encapsulated breaker which delays the release of the breaker, the effectiveness of such material on degrading polymer filter cake is poor due to: (1) After release, the breaker will spend itself on unbroken fracture fluid; and (2) After the stimulation is pumped, the dynamics within the created fracture are such that the breaker is in a stagnant situation such that the amount of area that it can contact after release is very small. For example, if the loading of an encapsulated breaker is on the order of 1.0 to 3.0 pounds per thousand gallons of fracturing fluid (as may be provided by a typical loading), the amount of breaker material deposited in the polymer filter cake is quite sparse. Therefore, the effectiveness of the breaker after release is dependent on the movement of fluids by the breaker. This would indicate that if the breaker is carried off by moving fluids returning to the aforementioned perforations, very little of the breaker would remain to contact and degrade the polymer filter cake.

Moreover, current art does not consider that the various breaker materials have appreciable useful half-lives. Halliburton Energy Services, the largest oil field service company in the world, published SPE paper 37228 in 1997, the disclosure of which is hereby incorporated herein by reference, documenting the use of oxidizing breakers and discussing half-life stabilities of these breakers. The paper, in FIG. 3 thereof, shows that for sodium persulfate (one of the most common breakers used in the industry) at temperatures above 200 degrees, the half-life is less than 10 minutes. Current art today is to conduct breaker tests in a lab, measuring the degree of degradation of viscosity with time at a given temperature. The temperature most often is set to be the same as actual down-hole conditions. A problem with this technique, especially concerning polymer filter cake removal, is that the tests are conducted under perfect conditions. When it is considered that flow back of the well after fracture stimulation takes days or even weeks, it becomes clear that the amount of active breaker left to react with filter cake or even any remaining unbroken gelled fluid would be expected to be very small.

It is believed that other attempts to remove polymer filter cake in a somewhat similar fashion consisted of pumping relatively small amounts of breaker ahead of the main treatment via a linear gel fluid pre-pad. However, in such a technique, it is believed by the inventors of the present invention that the breaker was very ineffective due to: (1) The limited amount of breaker; (2) The breaker will spend itself on the linear gel; and (3) There is not enough breaker left to compensate for half-life degradation to degrade or remove any polymer filter cake that is formed during the main treatment.

Attempts at working around the use of polymer gels for delivery of proppants, and thus to reduce damage associated with polymer filter cakes, have included pumping massive amounts of proppants into a well using a non-viscosified or relatively slightly viscosified fluid. However, these techniques have generally not been successful as it is typically not possible to force a well to accept massive amounts of proppants, in addition to the results being highly unpredictable with respect to the delivery of the proppants into the created fracture.

Accordingly, as problematic as the formation of polymer filter cake is, the use of viscosified fracture treatments are typically desirable in order to provide lateral distribution of the proppant. However, the result of the use of polymer gel fluids to deliver the proppants is that in many cases only a third or less of the fracture created can actually contribute to production.

Accordingly, a need exists in the art for systems and methods to minimize damage resulting from polymer filter cake to fracture faces. A further need exists in the art for systems and methods adapted to provide improved removal of polymer filter cakes. A still further need exists in the art for systems and methods to provide improved communication between polymer filter cake and breaker agents to facilitate improved removal of polymer filter cakes.

BRIEF SUMMARY OF THE INVENTION

The present invention is directed to systems and methods in which a non-viscous fluid, having a heavy concentration of an appropriate breaker, is pumped into a well in front of viscosified fluid, such as a cross-linked polymeric fracturing fluid. According to a preferred embodiment, the non-viscous breaker fluid saturates the formation face and other permeable media and, preferably, penetrates the media to an appreciable depth, such as 2–3 inches. Thereafter, when a polymer filter cake is subsequently formed on the surfaces of the media the breaker is provided good communication with the polymer filter cake for its breakdown and removal. For example, as a hydraulic fracturing job is completed and the pressure reduced, e.g., for back flowing the viscosified fracturing fluid, the non-viscosified breaker fluid will preferably flow from the media and contact the polymer filter cake from the back side.

It should be appreciated that operation of the present invention results in being able to break a polymer filter cake much more effectively than traditional attempts to attack the polymer filter cake using a breaker on the inside of the polymer filter cake as the breaker of the present invention does not experience the aforementioned difficulties in being able to get the breaker down to the formation. Moreover, operation of the present invention does not suffer from problems with respect to damaging fracturing fluids prematurely or the breaker stagnating with diminished impact upon the polymer filter cake as reduction in hydraulic pressure within the fracture allows hydraulic pressure associated with the media to push the breaker into the polymer filter cake for excellent communication. Improved communication between the breaker and polymer filter cake of the present invention is particularly advantageous where cross-linked polymers are utilized as viscosifiers, as such cross-linked polymers are typically very difficult to breakdown.

The present invention does not suffer from the disadvantages associated with the breaker spending itself solely on viscosified fracturing fluids, as does the aforementioned use of encapsulated breakers and other techniques in which the breaker is carried by a viscosified fluid, as breaker of preferred embodiments of the present invention is disposed to initially interface with polymer filter cake. Moreover, communication between the breaker and the polymer filter cake is substantially controlled by the operator in that the breaker remains saturated in the permeable media until such time as the operator commences recovery of the fracturing fluids at which time the pore-pressure within the permeable media forces the breaker to flow into the polymer filter cake. Accordingly, breaker is not spent unnecessarily or prematurely in operation according to embodiments of the present invention.

In operation according to preferred embodiments of the present invention, polymeric residue is removed to reduce formation damage in a variety of ways. For example, by having the breaker on the outside of the polymer filter cake, as the breaker flows through the polymer filter cake the breaker removes the polymer filter cake, thus exposing more formation that can contribute to hydrocarbon production. Moreover, the flow path of breaker according to the present invention also results in excellent communication between the breaker and the polymer gel disposed in the fracture, thereby reducing proppant pack damage. This allows the conductivity of the created fracture to be greater. Accordingly, embodiments of the present invention extend the effective fracture half length, reduces formation damage, and reduces proppant pack damage, thereby allowing a well to produce at higher rates and longer sustained rates than would otherwise be achievable through conventional breaker schedules.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
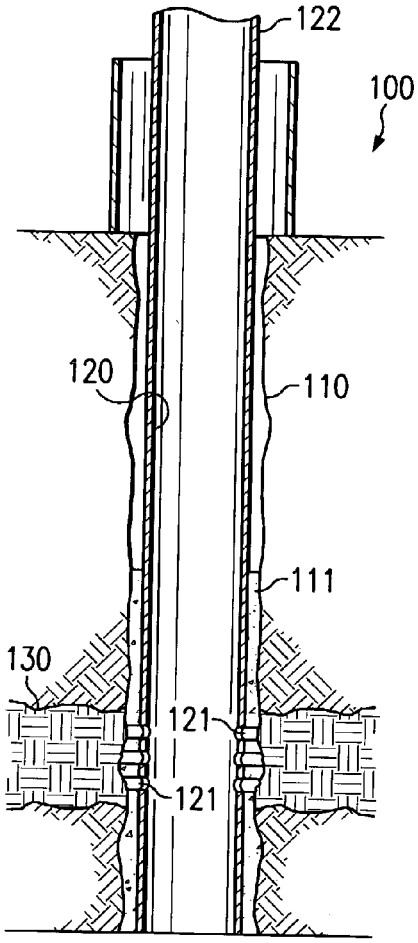
FIG. 1 shows a schematic diagram of a pre-completion wellbore as may be used in implementing embodiments of the present invention.

Directing attention to FIG. 1, a well, such as that which may be utilized in the production of hydrocarbons from reservoirs disposed deep within the Earth, is shown generally as well 100. Well 100 of the illustrated embodiment includes wellbore 110 which has been bored into the various Earthen strata, including hydrocarbon bearing pay-strata 130, in a conventional manner as is well known in the art. Wellbore 110 has a continuous pipe casing, shown as casing 120, disposed therein. In typical fashion, cement 111 is shown disposed annular to casing 120 to provide hydraulic isolation.

Well 100 of FIG. 1 is shown in a substantially pre-completion state, i.e., the well has not been substantially processed to provide for commercial production of hydrocarbons from pay-strata 130. Although not yet at a completion state, well 100 of FIG. 1 does show the results of an early completion step in perforations, shown as perforations 121, disposed in casing 120 corresponding to pay-strata 130. These perforations allow hydraulic communication between the hydrocarbons of pay-strata 130 and the bore of casing 120, and thus well head 122.

However, in order to increase production of hydrocarbons and/or to increase the speed at which hydrocarbons may be extracted from the media of pay-strata 130, further well completion steps are typically performed. For example, in a common well completion step, fluid is introduced into well head 122 using pumps to increase the hydraulic pressure such that the structural pressures of the media of the pay-strata are exceeded and, thus, hydraulic fracturing occurs. Such fracturing results in increased exposed surface areas of the media of the pay-strata being in communication with the casing bore, via the casing perforations, and therefore improved hydrocarbon production typically results.

Figure 2:
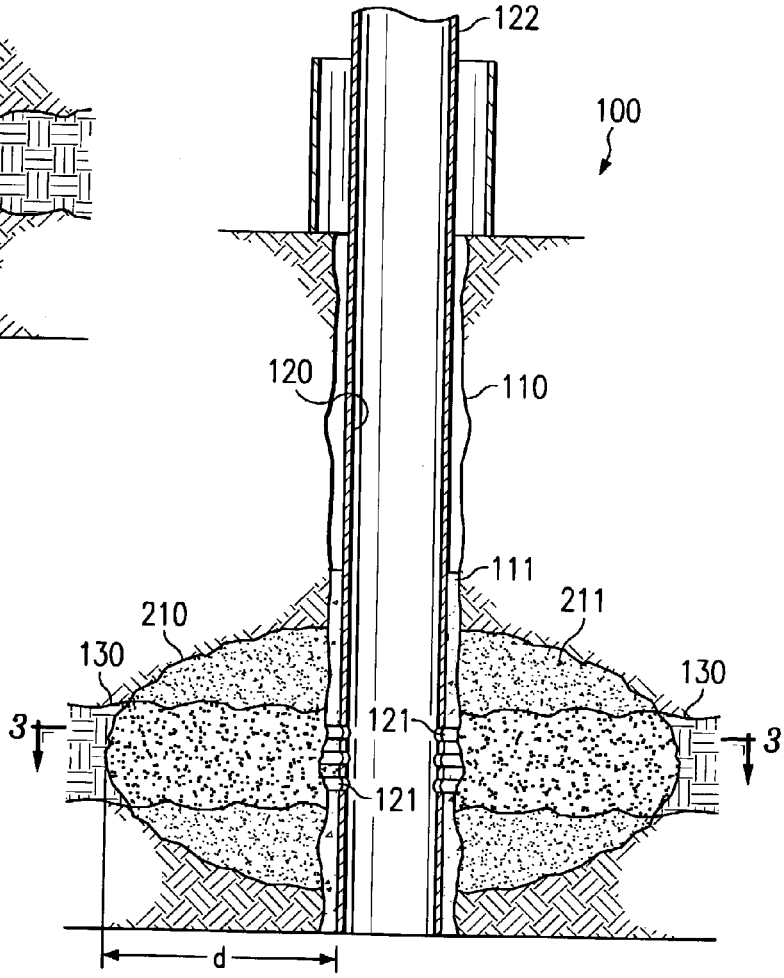
FIG. 2 shows a schematic diagram of a fractured well as may be treated using embodiments of the present invention.

Directing attention to FIG. 2, well 100 is shown after completion of a well fracturing step. Accordingly, fracture 210 having a fracture half-length, the lateral distance a fracture reaches from the borehole, of d is shown.

Non-viscous fluids, e.g., fluids having a viscosity of less than 10 centipoise (cp), typically provide a limited effectiveness with respect to creating hydraulic fractures. For example, produced fracture half-lengths associated with the use of non-viscous fluids tend to be only 50%, perhaps as much as 70%, as those achievable with viscous fluids, e.g., fluids having a viscosity of more than 10 cp.

Moreover, the fractures resulting from such hydraulic pressure have a tendency to close, or at least reduce in size, as the hydraulic pressure used to create the fracture is removed. Accordingly, proppants of various media, including sand, resin-coated sand, and ceramics, have been introduced into the hydraulic fractures to prevent the fractures from closing when the hydraulic pressure used to create the fracture is removed. Proppants 211 are shown disposed in fracture 210 in FIG. 2.

However, it should be appreciated that proppants are typically heavier than the fluids used in hydraulic fracturing operations and, therefore, present problems with respect to their being deposited in and/or throughout a fracture. Accordingly, viscosified fluids, such as may result from the addition of polymers, such as guar, HPG, CMHPG, HEC, CMHEC, CMC, and the like, to produce a linear gel capable of suspending proppants, have been utilized in hydraulic fracturing treatments. Cross-linked gelled fluids may be produced by adding cross-linking agents, such as compounds of borate, titanium, zirconium, antimony, aluminum, and the like, to provide for better suspension of proppants and/or to provide a fluid having a desired viscosity using a lesser viscosifying load.

Figure 3:
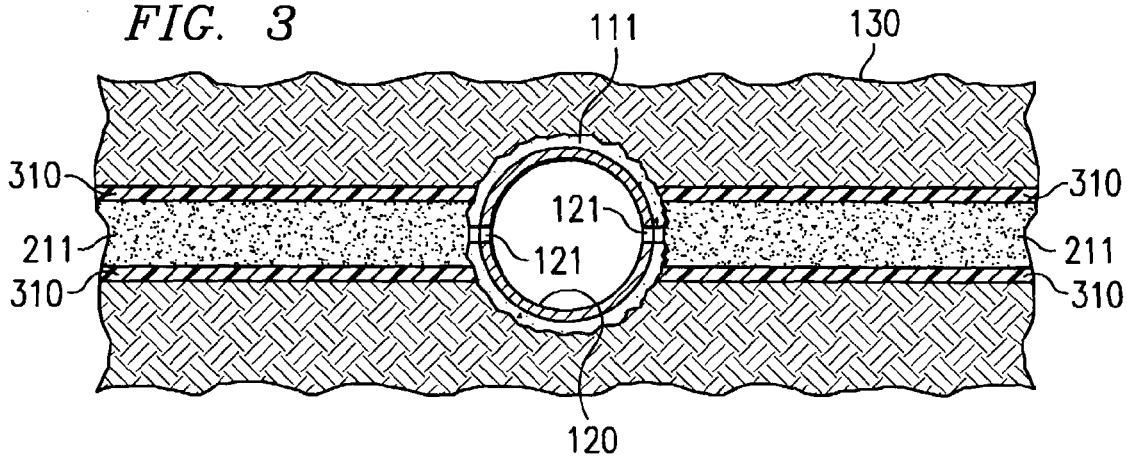
FIG. 3 shows a cross section view from the top of the fractured well of FIG. 2.

The use of viscosified fluids in providing hydraulic fracturing and/or delivery of proppants to a fracture is itself not without problems. For example, the polymeric viscosifiers tend to accumulate or plate along the faces of the porous media being fractured and thereby form a polymer filter cake restricting or preventing the flow of hydrocarbons therethrough. Directing attention to FIG. 3, well 100 is shown in a cross-sectional view from the top where polymer filter cakes 310 are seen disposed upon the surfaces of fracture 210.

Although various breaker agents, such as may comprise oxidative (e.g., ammonium and sodium persulfate) or enzyme agents, may be used to dissolve or breakdown the viscosifying polymers, delivery of such breakers to the polymer filter cake is problematic. Accordingly, embodiments of the present invention provide systems and methods in which breaker agents are delivered to, and preferably saturates the rear fracture face of, the media being fractured before the introduction of viscosified fluid. Preferably, a non-viscous fluid, having a heavy concentration of an appropriate breaker, is pumped into a well in front of viscosified fluid used in completing the well. According to a preferred embodiment, the non-viscous breaker fluid saturates the permeable media being fractured and saturates the media to an appreciable depth, such as 2–3 inches. Thereafter, when a polymer filter cake is subsequently formed on the surfaces of the media the breaker is provided good communication with the polymer filter cake for its breakdown and removal.

Figure 4:
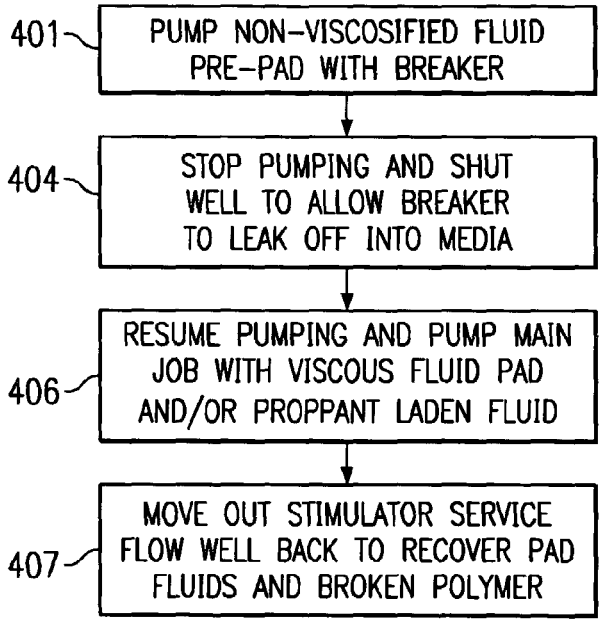
FIG. 4 shows a flow diagram implementing steps according to an embodiment of the present invention.

Directing attention to FIG. 4, steps of a preferred embodiment providing for removal of polymer filter cake and/or breaking down of polymeric gel according to the teachings of the present invention are shown. The embodiment illustrated in FIG. 4 comprises pumping a non-viscosified fluid pre-pad, such as may comprise water, water with a friction reducer, water energized with gases (e.g., nitrogen and carbon-dioxide), etcetera, with a suitable breaker into the well (step 401).

The pre-pad with breaker in step 401 may follow other treatments of a hydraulic fracturing process. For example, a non-viscosified fluid pre-pad, such as may comprise water, water with a friction reducer, water energized with gases (e.g., nitrogen and carbon-dioxide), etcetera, without the aforementioned breaker may be pumped into the well to initiate fracturing and/or to determine if the well will accept the injection of the completion fluids. Such a pre-pad may be utilized to begin the fracturing process and/or to determine if the well will accept the injection of the completion fluids. For example, a relatively small amount of this pre-pad fluid, such as on the order of 500 to 1,000 gallons if the well is loaded (i.e., the well is already completely filled to surface with water) may be pumped under pressure, such as on the order of 500–1000 pounds per square inch (psi) above fracture initiation pressure, down through well head 122 (FIG. 1). The hydraulic pressure may be communicated to pay-strata 130 via perforations 121 to cause pay-strata 130 to begin fracturing (e.g., fracture 210 of FIG. 2 begins to extend away from the wellbore).

Assuming the well accepts the injection of the aforementioned pre-pad treatment, an acid pre-pad may be pumped into the well. For example, a small volume, such as on the order of 2,000 gallons for a typical well, of acid, e.g., 15% raw acid, may be pumped under pressure, such as on the order of 500–1000 psi above fracture initiation pressure, down well head 122. Such an acid pre-pad may be provided to dissolve a portion of the cement disposed in the well bore, e.g., cement 111 disposed annularly to casing 120 within well bore 110, and is not effective in removing polymer filter cake. Dissolving a portion of this cement results in a cleaner entry point to the fracture, e.g., fracture 210. For example, such acid treatments have resulted in from approximately 500 to approximately 2,000 psi reduction in treating pressure when the acid reaches the perforations.

However, it is generally desired to retain at least a portion of the cement to provide hydraulic isolation with respect to other strata traversed by the well bore. Accordingly, the aforementioned acid pre-pad may be followed by a fluid treatment providing for the flushing or displacing of the acid pre-pad. This flushing pre-pad may be continued under pressure, such as on the order of 500–1000 psi plus an amount to compensate for pipe friction, without shut downs or flow reductions until a predetermined amount of fluid has been pumped down the well to ensure proper displacement of the acid.

Accordingly, it should be appreciated that the non-viscosified fluid pre-pad with breaker of step 401 may follow one or more of the aforementioned hydraulic treatments or other non-viscosified fluid treatments, if desired. For example, according to a preferred embodiment, a non-viscosified fluid pre-pad with breaker is utilized in flushing the aforementioned acid treatment. Additionally or alternatively, a plurality of non-viscosified fluid pre-pad with breaker treatments of the present invention may be provided, such as a treatment before the aforementioned hydraulic treatments and a treatment following the aforementioned hydraulic treatments.

According to the illustrated embodiment, the non-viscosified fluid pre-pad with breaker treatment of step 401 comprises a heavy loading of an appropriate breaker. An appropriate breaker preferably is one that corresponds to a particular agent design to be used at particular down-hole conditions in a subsequent treatment to thereby provide breaking down of that agent. However, a particular appropriate breaker may be selected based upon a number of considerations, such as a breaker which will be readily accepted by the porous media of a pay-strata being fractured considering bottom-hole temperature and type of viscosifier (e.g., gelling agent), a breaker which is readily recoverable from the well, etcetera. Breakers utilized according to preferred embodiments of the present invention are a liquid or in a solution form when pumped into the well to thereby facilitate saturation of porous media of a fracture with the breaker.

The pre-pad with breaker treatment of step 401 of the illustrated embodiment preferably comprises a non-viscous fluid, e.g., water, water with a friction reducer, etcetera, heavily loaded with the aforementioned breaker. For example, such a main pre-pad treatment according to a preferred embodiment comprises a relatively large amount of water, such as on the order of 15,000 to 30,000 gallons, loaded with approximately 2 to 5 gallons of breaker per thousand gallons of water. Of course other loadings of breaker may be utilized, such as to accommodate particular temperatures, pressures, and/or operating characteristics, if desired. For example, the concentrations for lower temperature applications may be increased appropriately, such as to provide for flow back within a desired window of time. However, it is desired that the amount of breaker utilized according to the preferred embodiment be sufficient to reduce polymer filter cake damage by attacking the polymer filter cake from the back side (e.g., pay-structure media side) during periods of reduced hydraulic pressure within the well (e.g., during back flowing of the well after hydraulic fracturing).

According to the illustrated embodiment, the well is shut in for a period of time (step 402), preferably containing the hydraulic pressure to prevent flow back of the various pre-pads. This shut in period, such as may extend for approximately 30 minutes to 2 hours, preferably allows time for the fluid bearing the breaker to permeate and/or saturate the media of the pay-strata. According to a preferred embodiment, the fluid bearing the breaker penetrates the media to a depth of at least 2 to 3 inches. Such penetration of the media by breaker according to preferred embodiments is not just with respect to the media adjacent the well bore, but penetrates media along an initiated fracture to such depths. Accordingly, embodiments of the present invention "load" an appreciable amount of the media with breaker bearing fluid and maximize the amount of media surface area associated with such breaker loading. Additionally, this shut in period may be utilized to evaluate the pressure response of the well, providing information with respect to the characteristics of the formation being fractured.

After the shut in period of the illustrated embodiment, the fracturing job is preferably again started to pump under pressure, such as on the order of 500–1000 psi above fracturing initiation pressure, another hydraulic treatment (step 403). This subsequent treatment may comprise a main job with viscous fluid pad and/or proppant laden fluid or my comprise another pre-pad of non-viscous fluid followed by a main job pad.

For example, a pre-pad treatment following the shut in period may be provided which has a concentration of breaker, preferably having a somewhat lower breaker loading than the first breaker laden treatment because this subsequent treatment may have the main job tailed in without shutting down. Such a subsequent pre-pad may comprise approximately 50,000 to 100,000 gallons of non-viscosified fluid, e.g., water, water with friction reducer, water energized with gasses, etcetera, loaded with approximately 0.5 to 1.0 gallons per thousand of breaker. Of course other loadings of breaker may be utilized, such as to accommodate particular temperatures, pressures, and/or operating characteristics, if desired. However, it is desired that the amount of breaker utilized according to the preferred embodiment be determined to both provide assistance to the breaker of the initial treatment of breaker in reducing polymer filter cake damage as well as not prematurely breaking down the viscosifier of the main treatment in contact therewith. The use of such a pre-pad treatment following the aforementioned shut in is optional according to embodiments of the present invention and.

It should be appreciated that, according to preferred embodiments, a spacer is not utilized between a breaker laden pre-pad treatment and the main job viscosified fluid. Instead, hydraulic pressure may be relied upon to hold back the breaker such that it does not substantially interfere with the main job fracturing fluid until desired by the operator.

The main job of the fracturing treatment, preferably comprising a very large volume of viscous fluid and/or proppant laden fluid, e.g., on the order of 50,000–800,000 gallons, is provided after the shut in period of step 402 to fully establish the created dimensions and/or to create width in the fracture. As mentioned above, this main job may be tailed in behind a second breaker laden pre-pad or following the shut in period without the aforementioned second breaker laden pre-pad, e.g., the main fracturing treatment may immediately follow the aforementioned shut in period.

It should be appreciated that the application of this main job, according to preferred embodiments, is the first to introduce viscous into the fracture and, therefore, the breaker agents of the breaker pre-pad of the illustrated embodiment are disposed upon the media side (outside) of a resulting polymer filter cake. According to preferred embodiments of the present invention, the main treatment is continued as designed (e.g., a predetermined volume of viscosified fluid and/or proppant material has been pumped) or as pressures permits (e.g., a casing rupture pressure is approached).

After the main job of the fracturing treatment is completed, the job may be flushed and the well cleaned for production (step 404). For example, a fluid stimulator service may be moved out and the well flowed back to recover the pad fluids and broken polymer. Preferably, the well is allowed to back flow to allow the breaker disposed in the fractured media to flow back into the fracture, thereby interfacing with the polymer filter cake and/or proppant pack gel to breakdown the polymeric viscosifier and clean the well. For example, within three to four hours after the treatment is pumped, the load may be expected to flow back to the surface at 50 to 300 barrels of fluid per hour as the breaker reacts with the polymer filter cake.

Figure 5:
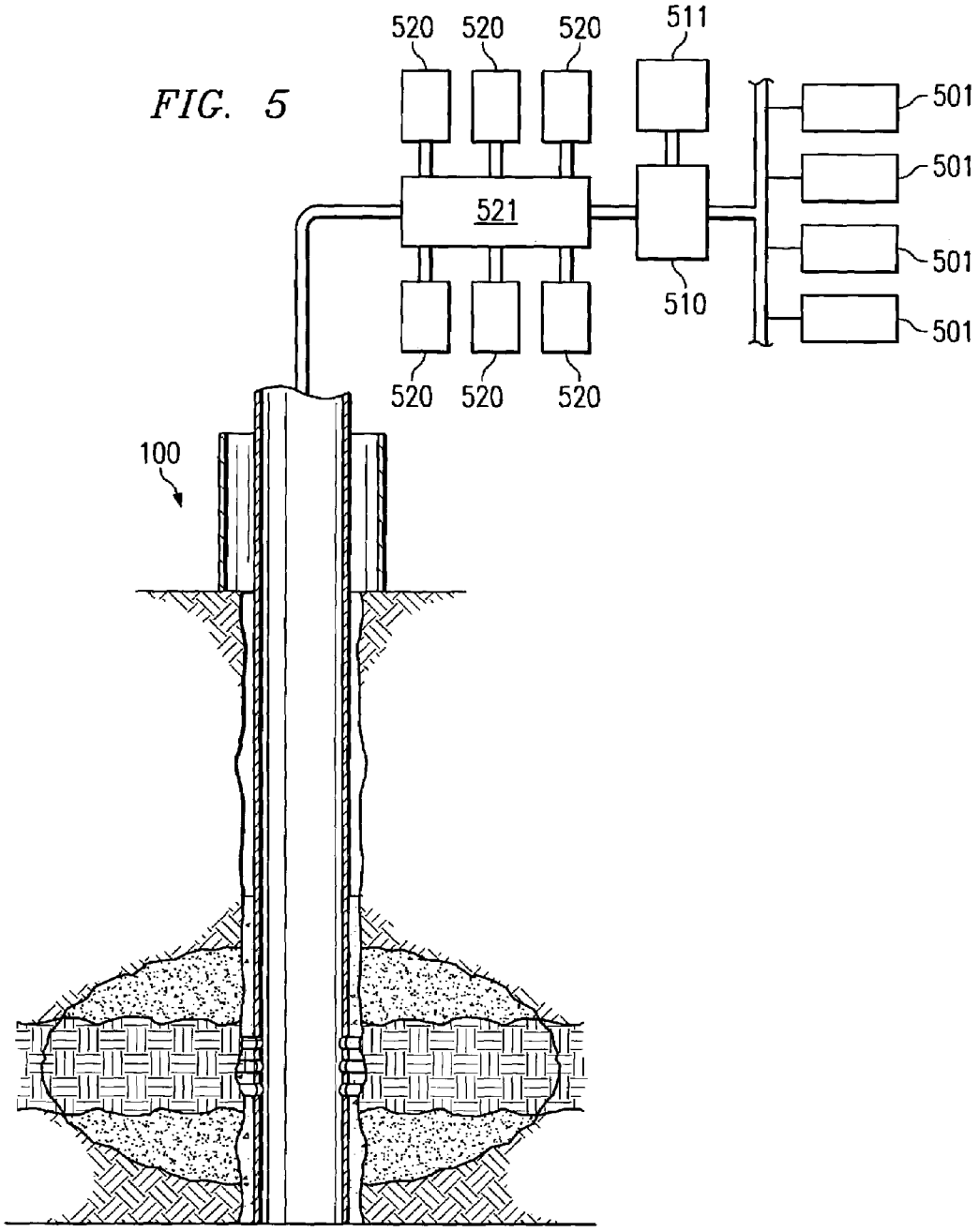
FIG. 5 shows a system adapted to implement an embodiment of the present invention.

Directing attention to FIG. 5, a system adapted to implement an embodiment of the present invention is represented in a block diagram. System 500 is coupled to well 100 to provide hydraulic communication of various fluids utilized according to the present invention thereto. The illustrated embodiment of system 500 comprises tanks 501, such as may comprise one or more fluids, such as water, water with a friction reducer, viscosified water, etcetera, utilized in implementing the present invention. Blender 510, coupled to tanks 501, provides blending of a desired agent or other material with fluids contained in one or more of tanks 501. For example, blender 510 may be utilized to blend a breaker agent, a friction reducer, a viscosifier, and/or proppants into a fluid or fluids stored in tanks 501. Accordingly, tank 511, such as may store any one or more of the aforementioned agents or other materials, is in communication with blender 510. The fluid as blended by blender 501 is provided to manifold 521 having pumps 520 coupled thereto. Specifically, pumps 520 have both a suction side and discharge side coupled to manifold 521 to thereby provide combined pumping of the blended fluid into well 100.

Implementation of the present invention preferably increases the effective half-length of a fracture by removing more polymer filter cake damage than is possible with typical breaker treatments. Moreover, implementation of the present invention also preferably improves the proppant pack conductivity by better removing gel residue and any remaining unbroken fracture fluid from the proppant pack.

It should be appreciated that, although preferred embodiments have been described above with reference to particular operating parameters, the present invention is not limited to the specifics of the embodiments described herein. For example, the volumes and/or pressures of the various pre-pad, pad, and/or proppant laden fluids implemented in any particular situation may be different than those described. Similarly, the loading of breaker in the various pre-pads of embodiments of the invention may be different than those discussed.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of hydraulically treating a well, said method comprising:

mixing a breaker agent with a non-viscous fluid, thereby providing a non-viscous breaker treatment fluid;

pumping said non-viscous breaker treatment fluid into said well prior to introduction of a viscosified treatment fluid in said well;

shutting in said well to contain a hydraulic pressure of said non-viscous breaker treatment fluid for a period of time within the range of from 30 minutes to 2 hours;

introducing a viscosified liquid to said face of porous media only after allowing said shutting in said well; and maintaining a hydraulic pressure with respect to said well during said introducing said viscosified liquid to said face of porous media to limit interfacing of said non-viscous breaker treatment with a viscosifying agent.

2. The method of claim 1, wherein said breaker agent is selected to correspond to a viscosifying agent to be pumped into said well following said pumping said non-viscous breaker treatment.

3. The method of claim 1, wherein said breaker agent is mixed with said non-viscous fluid in a relatively high concentration.

4. The method of claim 3, wherein said relatively high concentration is in the range of approximately 2 to 5 gallons of breaker agent per thousand gallons of non-viscous fluid.

5. The method of claim 1, wherein said breaker agent comprises an oxidative agent.

6. The method of claim 1, wherein said breaker agent comprises an enzyme agent.

7. The method of claim 1, wherein said non-viscous fluid comprises water.

8. The method of claim 7, wherein said water is energized with gases.

9. The method of claim 1, wherein said non-viscous fluid comprises water with a friction reducer.

10. The method of claim 9, wherein said water is energized with gases.

11. The method of claim 1, wherein said period of time of said shutting in said well is selected to allow said non-viscous breaker treatment to saturate a face of porous media in communication with said well, said face comprising a hydraulically initiated fracture face.

12. The method of claim 11, wherein said saturation of said face by said non-viscous breaker treatment is to a depth in the range of from 2 to 3 inches into said porous media.

13. The method of claim 1, further comprising:

mixing said breaker agent with a non-viscous fluid, thereby providing a second non-viscous breaker treatment fluid;

pumping said second non-viscous breaker treatment fluid into said well.

14. The method of claim 13, wherein said viscosified liquid introduced to said face of porous media is pumped into said well behind said pumping said second non-viscous breaker treatment fluid without a spacer therebetween.

15. The method of claim 13, wherein a concentration of said breaker agent in said second non-viscous breaker treatment fluid is less than a concentration of said breaker agent in said non-viscous breaker treatment fluid.

16. The method of claim 1, wherein said viscosified liquid introduced to said face of porous media is pumped into said well behind said non-viscous breaker treatment fluid without a spacer therebetween.

17. The method of claim 1, comprising:

reducing said hydraulic pressure to allow said non-viscous breaker treatment to interface with a viscosifying agent.

18. The method of claim 1, wherein said pumping said non-viscous breaker treatment fluid is at a pressure greater than a fracture initiation pressure of said well.

19. The method of claim 1, further comprising:

pumping a non-viscous pre-pad treatment fluid into said well prior to said pumping said non-viscous breaker treatment fluid, wherein said pumping said non-viscous pre-pad treatment fluid is at a pressure greater than a fracture initiation pressure of said well.

20. The method of claim 1, further comprising:

pumping an acid pre-pad treatment fluid into said well.

21. The method of claim 20, wherein said pumping said acid pre-pad treatment fluid is at a pressure greater than a fracture initiation pressure of said well.

22. The method of claim 20, wherein said pumping said acid pre-pad treatment fluid is prior to said pumping said non-viscous breaker treatment fluid.

23. A method of hydraulically treating a well, said method comprising:

mixing a breaker agent with a non-viscous fluid, thereby providing a non-viscous breaker treatment fluid; and saturating a fracture face of porous media in communication with said well with said non-viscous breaker treatment fluid, wherein said non-viscous breaker treatment fluid penetrates said fracture face to a depth in the range of from 2 to 3 inches.

24. The method of claim 23, wherein said saturating said face of porous media comprises:

pumping said non-viscous breaker treatment fluid into said well under pressure;

shutting in said well with said non-viscous breaker treatment under pressure.

25. The method of claim 24, wherein said shutting in said well is for a period of at least 30 minutes.

26. The method of claim 24, wherein said shutting in said well is for a period in the range of approximately 30 minutes to 2 hours.

27. The method of claim 24, wherein said pumping pressure of said non-viscous breaker treatment fluid is greater than a fracture initiation pressure of said well.

28. The method of claim 24, further comprising:

mixing said breaker agent with a non-viscous fluid, thereby providing a second non-viscous breaker treatment fluid;

after shutting in said well, pumping said second non-viscous breaker treatment fluid into said well.

29. The method of claim 23, further comprising:

after saturating said face of porous media with said non-viscous breaker treatment fluid; and hydraulically fracturing said porous media using a viscosified fluid.

30. The method of claim 29, wherein said viscosified fluid is pumped into said well without a spacer fluid between said non-viscous breaker treatment fluid and said viscosified fluid.

31. The method of claim 29, wherein said viscosified fluid is pumped into said well behind a second non-viscous breaker treatment fluid having a breaker concentration less than said non-viscous breaker treatment fluid saturating said fracture face.

32. The method of claim 29, further comprising:

after hydraulically fracturing said porous media, reducing a hydraulic pressure on said well to allow said non-viscous breaker treatment fluid to de-saturate said face of porous media.

33. The method of claim 23, further comprising:

initiating fracturing of said porous media using a non-viscous pre-pad treatment fluid, said non-viscous pre-pad treatment fluid thereby creating said fracture face of porous media.

34. The method of claim 23, further comprising:

treating said well with an acid pre-pad fluid; and pumping said non-viscous breaker treatment fluid into said well to flush said acid pre-pad fluid, said non-viscous breaker treatment saturating said fracture face of porous media after flushing said acid.

35. A method of preparing a well for production, said method comprising:

pumping a non-viscous pre-pad fluid into said well at a pressure above a fracture initiation pressure of said well;

pumping a volume of non-viscous fluid having a breaker agent therein into said well after said non-viscous pre-pad fluid;

allowing said non-viscous fluid having said breaker agent therein to saturate at least a portion of a fracture face of porous media in communication with said well;

introducing a viscosified fluid to said face of porous media only after said allowing said non-viscous fluid having said breaker agent therein to saturate said face; and pumping a volume of a second non-viscous fluid having said breaker agent therein into said well, wherein said viscosified fluid is introduced to said fracture face of porous media after said pumping said volume of said second non-viscous fluid having said breaker agent therein.

36. The method of claim 35, wherein breaker agent is in a high concentration in said non-viscous fluid.

37. The method of claim 36, wherein said high concentration is in the range of approximately 2 to 5 gallons of breaker agent per thousand gallons of non-viscous fluid.

38. The method of claim 35, wherein said volume of said non-viscous fluid is in the range of approximately 20,000 to 30,000 gallons.

39. The method of claim 35, wherein said volume of said second non-viscous fluid is in the range of approximately 50,000 to 100,000 gallons.

40. The method of claim 35, wherein a concentration of said breaker in said non-viscous fluid is greater than a concentration of said breaker in said second non-viscous fluid.

41. The method of claim 35, wherein said viscosified fluid is introduced to said face of porous media by pumping said viscosified fluid behind pumping said volume of said second non-viscous fluid having said breaker agent therein without a spacer therebetween.

42. A system for hydraulically treating a well, said system comprising:

means for pumping a volume of non-viscous fluid having a breaker agent therein into said well;

means for shutting in said well holding said non-viscous fluid having a breaker agent therein under pressure allowing said non-viscous fluid having said breaker agent therein to saturate at least a portion of a face of porous media in communication with said well;

means for pumping a viscosified fluid into said well after said non-viscous fluid having said breaker agent therein has saturated said face; and means for pumping a volume of a second non-viscous fluid having said breaker agent therein into said well, wherein said viscosified fluid is pumped into said well after said pumping said volume of said second non-viscous fluid having said breaker agent therein.

43. The system of claim 42, further comprising:

means for pumping a volume of acid pre-pad treatment fluid into said well, wherein said means for pumping said volume of non-viscous fluid having a breaker agent therein flushes said acid using said non-viscous fluid having a breaker agent therein.

* * * * *